United States Patent [19]

del Valle

[11] 4,212,311

[45] Jul. 15, 1980

[54] BATTERY OPERATED EYELASH CURLER

[76] Inventor: Leon del Valle, 10924 Aletta Ave., Culver City, Calif. 90213

[21] Appl. No.: 936,260

[22] Filed: Aug. 23, 1978

[51] Int. Cl.[2] ..... A45D 2/00

[52] U.S. Cl. ..... 132/31 A

[58] Field of Search ..... 132/31 A

[56] References Cited

U.S. PATENT DOCUMENTS

| | | | |
|---|---|---|---|
| 1,925,266 | 9/1933 | Manning | 132/31 A |
| 2,684,679 | 7/1954 | Kislig | 132/31 A |

*Primary Examiner*—G. E. McNeill

*Attorney, Agent, or Firm*—Ben E. Lofstedt

[57] ABSTRACT

A manually operable eyelash curler including a pair of curved arms housed within a stationary frame, which when mechanically depressed along the outermost curved portion, drives a movable, non-electrically heated eyelash compressing element into intimate contact with a stationary electrically heated eyelash compressing element, a centrally-disposed battery pack to provide the electrical energy to heat the electrically heated eyelash compressing element, a first electrical switch which arms the electrical circuit, and a second electrical switch operably associated with one of the curved arms to energize the electrically heated eyelash compressing element when the curved arm is manually depressed.

3 Claims, 1 Drawing Figure

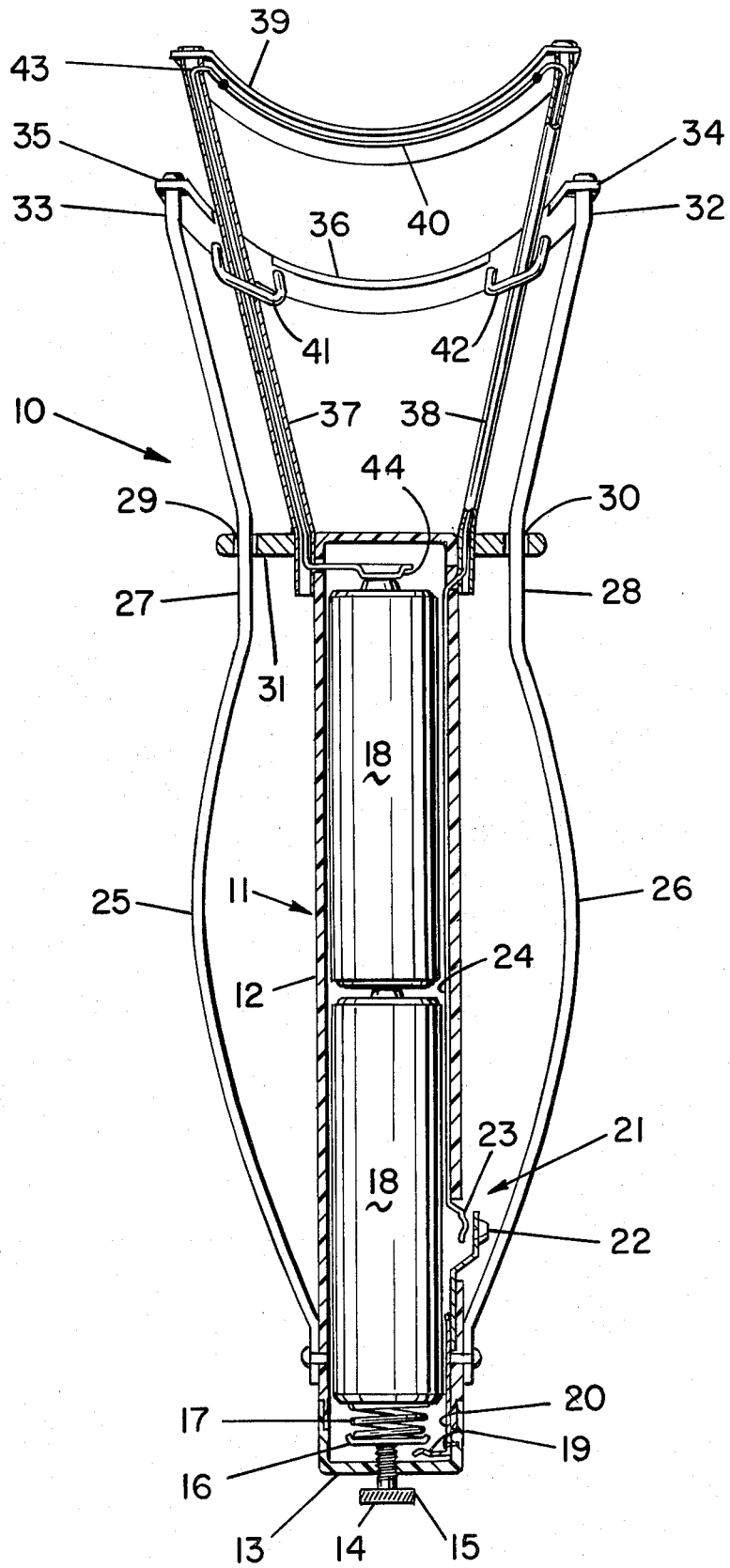
39
43
35
34
33
32
36
40
41
42
10
37
38
44
29
30
27
28
31
18
25
11
26
24
12
23
21
18
22
20
17
19
16
13
14
15

BATTERY OPERATED EYELASH CURLER

BACKGROUND OF THE INVENTION

1. Field of the Invention

The present invention relates to the field of eyelash curlers, and, more particularly, to battery-operated, electrically heated eyelash curlers.

2. Description of the Prior Art

Most eyelash curlers found in the prior art which are characterized by manual operation, function by the application of continued pressure to a pair of cooperating nonheated members between which the eyelashes are sandwiched. By the application of this pressure for a substantial period of time, the eyelashes are trained to form the shape desired. Not only is this process lengthy and tedious, but it also has a tendancy to break the hair.

Another type of eyelash curling device which employs an electric heating element in cooperation with a pair of pressing surfaces to curl false eyelashes is disclosed in U.S. Pat. No. 3,525,347 (D'Elia). However, it should be clearly noted that this particular device is not physically suitable for use with real eyelashes or false eyelashes which are attached at the time of curling to the eyelids of the person.

A yet another example of a prior art device is found in U.S. Pat. No. 3,838,699 (Skandalakis). This invention is directed towards a device for use in curling eyelashes. Basically, it is a manually operated device, which is a scissors-type mechanism, employing a first fixed eyelash receiving means and second similar means movable towards and away from the first means, the eyelashes being disposed between these two means. The second means conveniently supplied with energy from batteries contained in the device itself.

However, it should be noted that while this device appears to be quite similar to the present invention disclosed hereinafterwards more fully, that numerous and substantial distinctions are present between the two devices. As an example, Skandalakis uses a scissors mechanism to drive the movable eyelash receiving means towards the fixed eyelash receiving means; the present invention does not, but instead uses a more compact, less costly mechanism.

Further, Skandalakis uses a bell-crank mechanism which is cumbersome and unsightly, as well as being relatively costly to use as shown.

Additionally, as depicted in FIG. 2 of the Skandalakis patent, the hollow housing 26 containing the removable dry cells 28 and an on-off switch 30, couples with the vertical shaft 34, the linkage 32, and the elongated brace 36, all form a dangerous movable protrusion facing the face of the user. The device disclosed by the applicant hereby eliminates such dangerous protrusions and the risk of injury to the face.

SUMMARY OF THE INVENTION AND OBJECTS

The instant invention fully described and disclosed by the applicant herein, includes a pair of outwardly curved arms housed within a stationary frame. When mechanically depressed by the fingers of the user along the outermost curved portion of the arms, the arms are extended and drive a movable eyelash compressing element which is connected to the extremities of the curved arms into intimate contact with a stationary, electrically-heated eyelash compressing element, a battery pack mounted within the frame to provide the electrical energy to heat the electrically heated eyelash compressing element, a first electrical switch which arms the electrical circuit, and a second electrical switch operably associated with one of the curved arms to energize the electrically heated eyelash compressing element when the curved arm is manually depressed.

It is an object of the present invention to provide an improved eyelash curling device.

Another important object of the instant invention is to provide a self-contained electrically heated eyelash curler operable in a manner which will quickly shape the eyelashes to the desired shape.

It is yet a still further primary and important object of the present invention to provide an electrically heated eyelash curler which will curl the lashes without pain or injury.

One object of the invention disclosed herein is to provide an electrically heated eyelash curler which is structurally simple, is operated easily and may be rapidly cleaned to ensure sanitary operation.

Other characteristics, advantages and objects of this invention can be more readily appreciated from the following description and appended claims. When taken in conjunction with the accompanying drawings, this description forms a part of the Specification wherein like references and characters designated corresponding parts in the view of the Drawing.

BRIEF DESCRIPTION OF THE DRAWING

The FIGURE is a view of the assembled invention with selected portions thereof shown partially in section.

DESCRIPTION OF THE PREFERRED EMBODIMENT OF THE INVENTION

In the preferred form of my improved eyelash curler, generally indicated at 10, there is provided an elongated tubular housing member, generally indicated at 11, forming a main support structure for the eyelash curler 10. The tubular member 11 is preferrably formed on an electrically non-conductive material, such as plastic or the like.

The tubular housing member 11 comprises two parts. The first part 12 is substantially larger than the second part 13 which acts as a closure member or cap for the first part 12. The second part 13 is adapted to be press-fitted or friction-fitted with the first part 12.

A pair of batteries 18, preferrably of the size AA variety, are housed within the tubular housing member 11.

Threadably disposed in the second part 13 of the housing member 11, is a finger-operable screw 14 with a head 15. A circular dish-like element 16 is securely attached to the other end of the screw 14 and is used as a back stop for a compression spring 17 disposed between the bottom of one of the batteries 18, typically forming the negative terminal or cathode of the batter 18.

The other battery 18 is disposed above the battery 18 in contact with the compression spring 17, and is electrically in series with the first battery 18.

Disposed beneath the dish-like element 16 is the arm 19 of an electrical conductor 20. As the screw is turned counterclockwise by the fingers, the element 16 will electrically contact the arm 19, thereby arming the electrical circuit and rendering it ready for operation as further described herein.

The opposite end of the electrical conductor 20 is formed into a pushbutton 22 actuatable electrical switch, generally shown at 21, which extends outside of the housing member 11. Disposed between the battery 18 and pushbutton 22, is the end 23 of yet another electrical conductor 24, which forms the other element of the electrical switch 21.

A pair of curved wire members 25, 26 are secured at one end to the opposite sides of housing member 11, and curve upwardly and outwardly therefrom. Near the top of the housing member 11, at the opposite end thereof, the curved members 25, 26 are formed into a straight section at 27, 28, respectively, and pass through a guide member 31. The guide member 31 not only serves to guide the members 25, 26 but also to maintain the members 25, 26 spaced apart from the housing member 11, as hereinafter described in detail.

Beyond the straight sections 27, 28, the members 25, 26 are directed upwardly and outwardly. The ends 32, 33 of the members 25, 26 are fixedly joined, respectively, at the opposite ends 34, 35 of the movable eyelash curling element 36.

The movable eyelash curling element 36 is typically a curved member consisting of a relatively soft rubber covered metal piece.

Secured in between the ends 32, 33 of the members 25, 26, are a complementary pair of hollow tubes 37, 38, one end of which is securely attached to the end of the first part 12 of the housing member 11 and the guide member 31. Mediately therebetween, the hollow tubes 37, 38, are loosely guided by metal loops 41, 42, which are fixedly secured to the movable eyelash curling element 36. The opposite ends of the hollow tubes 37, 38 are fixedly secured to the stationary eyelash curling element 39 which is curved to be complementarily mated with the curve of hte movable eyelash curling element 36. Similarly, the stationary eyelash curling element 39 is formed of a metal and rubber combination. However, embedded therewith is an electrical heating element 40 formed of resistance wire, such as Nichrome, and electrically insulated from the metal portion of the stationary curling element 39.

One end of the heating element 40 is electrically coupled to the electrical conductor 24 which is passed through an opening in the first part 12 and into the hollow tube 38 and to the stationary eyelash curling element 39. The opposite end of the heating element 40 is electrically coupled to an electrical conductor 43 which is passed through the hollow tube 37, through an opening in the first part 12 of the housing member 11 and terminating in an electrical conductor which is electrically coupled to the positive side of the battery 18 at 44.

OPERATION OF THE INVENTION

Operation of the invention is quite simple and is described hereinafterwards.

Initially, the improved eyelash curler of the present invention must be energized. This is accomplished by manually turning the finger operable screw 14 counterclockwise. This causes the dish-like element 16 at the end of the screw 14 to move downwardly into electrical contact with the arm 19 of the electrical conductor 20, thereby energizing or "arming" the electrical circuit of the present invention.

This energizing or arming sequence is desirable as the most frequent users of the present invention typically carry it in their purses or pocketbooks where it is possible to inadvertently cause the electrical element to be heated which runs down the batteries 18 rather quickly. Hence, this energizing or arming mechanism precludes this from occurring.

Once the eyelash curler 10 is energized or armed, it may be utilized.

The curved wire members 25, 26 are grasped between the fingers of one hand and the eyelash curler 10 is directed to the eyelash desired to be curled. The stationary eyelash curling element 39 and the movable eyelash curling element 36 are respectively positioned above and below the eyelash to be curled. The user then squeezes the curved wire members 25, 26 inwardly towards the batteries 18. At some point in time, the lower extremity of the inside of the curved wire member 26 physically contacts the pushbutton 22, which, in turn, electrically contacts the end 23 of the electrical conductor 24. Once this occurs, the electrical circuit is completed and the electrical current flows from the series-arranged batteries 18 through the metal spring 17, the dish-like element 16, the arm 19 of the electrical conductor 20, the pushbutton 22, the end 23 of the electrical conductor 24, the heating element 40, the electrical conductor 43, and, returning to the battery 18 via the positive terminal at the junction 40 of the electrical conductor 43 and the positive terminal of the battery 18.

Concurrently with the electrical operation of the improved eyelash curler 10, the squeezing action on the curved wire members 25, 26 forces the straight sections 27, 28 to move upwardly while being constrained within the openings 29, 30 of the guide member 31. Thereafterwards, since the ends 32, 33 of the wire members 26, 25 are fixedly secured to the opposite ends of the movable eyelash curling element 36, the movable eyelash curling element 36 is directed upwardly towards the stationary eyelash curling element 39 and pressing the eyelash therebetween to effectuate physical and thermal compression thereof to produce rapid curling of the eyelash therebetween.

It should be noted and understood that the nature and embodiment of the invention herein described and illustrated is merely a convenient and useful form of the invention and that many changes may be made therein without departing from the true spirit and scope of the invention.

What I claim as new and desire to protect by Letters Patent of the United States is:

1. A manually-operable eyelash curler, comprising:
   (a) a pair of curved arms housed within a stationary frame, which when mechanically depressed along the outermost curved portion, drives a movable, non-electrically heated eyelash compressing element into intimate contact with a stationary electrically heated eyelash compressing element;
   (b) a centrally-disposed battery pack to provide the electrical energy to heat the electrically heated eyelash compressing element;
   (c) a first electrical switch which arms the electrical circuit; and
   (d) a second electrical switch operably associated with one or the curved arms to energize the electrically heated eyelash compressing element when the curved arm is manually operated.
2. The eyelash curler of claim 1, further comprising:
   (a) a hollow housing for the battery;
   (b) a guide member secured to the housing adjacent to said stationary frame for receiving and guiding said pair of curved arms therethrough to guide said arms in an upward direction when the curved arms are manually compressed towards said housing; and (c) alignment and guide means secured to the second eyelash curling element and loosely disposed about each of said stationary frame to maintain the non-electrically heated eyelash curling element in operative relationship with the electrically heated eyelash curling element when the curved arms are manually compressed.

3. A manually-operable, battery-powered, eyelash curler, comprising:

(a) a hollow housing for the battery;

(b) a pair of oppositely-disposed, elongated frame members secured to the housing;

(c) a first eyelash curling member bridging the frame members and connected thereto, said member having an electrical heating element therein and transversely disposed to the pair of frame members;

(d) a pair of curved arms, each having one end of which is secured to one end of the housing and the opposite ends of which are disposed adjacently to the first eyelash curling member wherein each of said curved arms curves outwardly away from the housing so that when manually depressed towards said housing, the first eyelash curling member is moved upwardly;

(e) a guide member secured to the housing adjacent to said pair of elongated frame members for receiving and guiding said pair of curved arms therethrough to guide said arms in an upward direction when the curved arms are manually compressed towards said housing;

(f) a second eyelash curling element secured to the ends of said curved arms adjacent to said first eyelash curling member;

(g) alignment and guide means secured to the second eyelash curling element and loosely disposed about each of said elongated stationary frame members to maintain the second eyelash curling element in cooperative relationship with the first eyelash curling element when the curved arms are manually compressed;

(h) a first electrical switch operatively associated with said battery and said electrical heating element in said first eyelash curling member for arming the electrical circuit; and (i) a second electrical switch operatively associated with said first electrical switch, said battery and said electrical heating element, whereby when said first electrical switch is turned on to conduct electrical current and said pair of curved arms is manually depressed sufficiently towards said housing, the second electrical switch is turned on, electrical current will be delivered from the battery through the first electrical switch and through the second electrical switch and into the electrical heating element in said first eyelash curling member to curl said eyelash squeezed between said first eyelash curling member and said second eyelash curling member.

* * * * *